US009638000B2

(12) United States Patent
Dyck

(10) Patent No.: US 9,638,000 B2
(45) Date of Patent: May 2, 2017

(54) METHOD AND APPARATUS FOR CONTROLLING THE FLOW OF FLUIDS INTO WELLBORE TUBULARS

(71) Applicant: David Paul Dyck, Calgary (CA)

(72) Inventor: David Paul Dyck, Calgary (CA)

(73) Assignee: Inflow Systems Inc., Calgary (CA)

( * ) Notice: Subject to any disclaimer, the term of this patent is extended or adjusted under 35 U.S.C. 154(b) by 400 days.

(21) Appl. No.: 14/328,519

(22) Filed: Jul. 10, 2014

(65) Prior Publication Data

US 2016/0010425 A1 Jan. 14, 2016

(51) Int. Cl.

| | |
|---|---|
| ***E21B 34/08*** | (2006.01) |
| ***E21B 41/00*** | (2006.01) |
| ***E21B 43/12*** | (2006.01) |

(52) U.S. Cl.

CPC ..... *E21B 34/08* (2013.01); *E21B 41/0078* (2013.01); *E21B 43/12* (2013.01)

(58) Field of Classification Search

CPC ..... E21B 34/08; E21B 34/00; E21B 34/06; E21B 43/12; E21B 43/123; E21B 41/0078; E21B 2034/001

See application file for complete search history.

(56) References Cited

U.S. PATENT DOCUMENTS

| | | | |
|---|---|---|---|
| 4,248,302 | A | 2/1981 | Churchman |
| 4,640,355 | A | 2/1987 | Hong et al. |
| 4,646,828 | A | 3/1987 | Schwab, Jr. et al. |
| 4,648,455 | A | 3/1987 | Luke |
| 4,770,244 | A | 9/1988 | Webb |
| 5,141,054 | A | 8/1992 | Alameddine et al. |
| 5,141,055 | A | 8/1992 | Chien et al. |
| 5,289,881 | A | 3/1994 | Schuh |
| 5,365,795 | A | 11/1994 | Brower, Jr. |
| 5,431,346 | A | 7/1995 | Sinaisky |
| 5,435,393 | A | 7/1995 | Brekke et al. |
| 5,464,059 | A | 11/1995 | Kristiansen |

(Continued)

FOREIGN PATENT DOCUMENTS

| | | |
|---|---|---|
| CA | 2450419 | 10/1997 |
| CA | 2238334 | 3/1998 |

(Continued)

OTHER PUBLICATIONS

Lauritzen et al., (2011) Single and Multi-phase Flow Loop Testing Results for Industry Standard Inflow Control Devices, Society of Petroleum Engineers, SPE-146347-MS.

*Primary Examiner* — Yong-Suk (Philip) Ro
(74) *Attorney, Agent, or Firm* — Parlee McClaws LLP; Susan Rancourt

(57) ABSTRACT

A flow restriction device for controlling flow of a fluid into a wellbore tubular from a production zone. The device comprises a housing and at least one divergent passageway having a throat section and a divergent section disposed within the housing, wherein the average angle of divergence in the divergent section is between 2° and 40°. Fluid is directed from the production zone, through the divergent passageway and into the wellbore. The divergent passageway may or may not comprise a convergent section before the throat. Also described is a flow restriction device in which the discharged flow is aligned at an angle of between 0 and 60 degrees of the direction of flow within the wellbore tubular. The flow restriction device is used to control distributed fluid flow into a wellbore tubular.

19 Claims, 9 Drawing Sheets

(56) References Cited

U.S. PATENT DOCUMENTS

| | | | |
|---|---|---|---|
| 5,626,193 | A | 5/1997 | Nzekwu et al. |
| 5,707,214 | A | 1/1998 | Schmidt |
| 5,743,717 | A | 4/1998 | Schmidt |
| 5,803,179 | A | 9/1998 | Echols et al. |
| 5,826,655 | A | 10/1998 | Snow et al. |
| 5,896,928 | A | 4/1999 | Coon |
| 6,112,815 | A | 9/2000 | Boe et al. |
| 6,112,817 | A | 9/2000 | Voll et al. |
| 6,158,510 | A | 12/2000 | Bacon et al. |
| 6,273,194 | B1 | 8/2001 | Hiron et al. |
| 6,367,547 | B1 | 4/2002 | Towers et al. |
| 6,371,210 | B1 | 4/2002 | Bode et al. |
| 6,505,682 | B2 | 1/2003 | Brockman |
| 6,516,888 | B1 | 2/2003 | Gunnarson et al. |
| 6,622,794 | B2 | 9/2003 | Zisk, Jr. |
| 6,679,324 | B2 | 1/2004 | Den Boer et al. |
| 6,708,763 | B2 | 3/2004 | Howard et al. |
| 7,631,694 | B2 | 12/2009 | Struyk et al. |
| 8,312,931 | B2 | 11/2012 | Xu et al. |
| 2007/0246210 | A1 | 10/2007 | Richards |
| 2007/0272408 | A1 | 11/2007 | Zazovsky et al. |
| 2008/0314590 | A1 | 12/2008 | Patel |

FOREIGN PATENT DOCUMENTS

| | | |
|---|---|---|
| CA | 2280813 | 8/1998 |
| CA | 2217638 | 11/1998 |
| CA | 2236944 | 11/1998 |
| CA | 2243793 | 1/1999 |
| CA | 2243795 | 1/1999 |
| CA | 2219513 | 5/1999 |
| CA | 2423547 | 4/2002 |
| CA | 2369860 | 7/2002 |
| CA | 2572596 | 11/2002 |
| CA | 2776435 | 4/2005 |
| CA | 2614645 | 3/2007 |
| CA | 2627141 | 9/2008 |
| CA | 2700320 | 4/2009 |
| CA | 2716802 | 9/2009 |
| CA | 2813503 | 9/2009 |
| CA | 2668983 | 12/2009 |
| CA | 2763721 | 12/2010 |
| CA | 2768208 | 2/2011 |
| CA | 2782343 | 6/2011 |
| CA | 2787332 | 8/2011 |
| CA | 2793364 | 9/2011 |
| CA | 2794539 | 10/2011 |
| CA | 2813763 | 10/2011 |
| CA | 2746901 | 1/2012 |
| CA | 2816614 | 6/2012 |
| CA | 2822571 | 7/2012 |
| CA | 2740158 | 11/2012 |
| CA | 2776072 | 11/2012 |
| CA | 2833767 | 11/2012 |
| CA | 2834294 | 11/2012 |
| CA | 2749437 | 2/2013 |
| CA | 2838164 | 3/2013 |
| CA | 2830959 | 5/2013 |
| CA | 2762439 | 6/2013 |
| CA | 2762448 | 6/2013 |
| CA | 2801562 | 7/2013 |
| CA | 2766838 | 8/2013 |
| CA | 2766844 | 8/2013 |
| CA | 2766849 | 8/2013 |
| CA | 2778713 | 8/2013 |
| CA | 2816646 | 11/2013 |

10
12
20
21
22
24
25
26
28
29
30
32
34
36
38
40
41
42
43
44
B

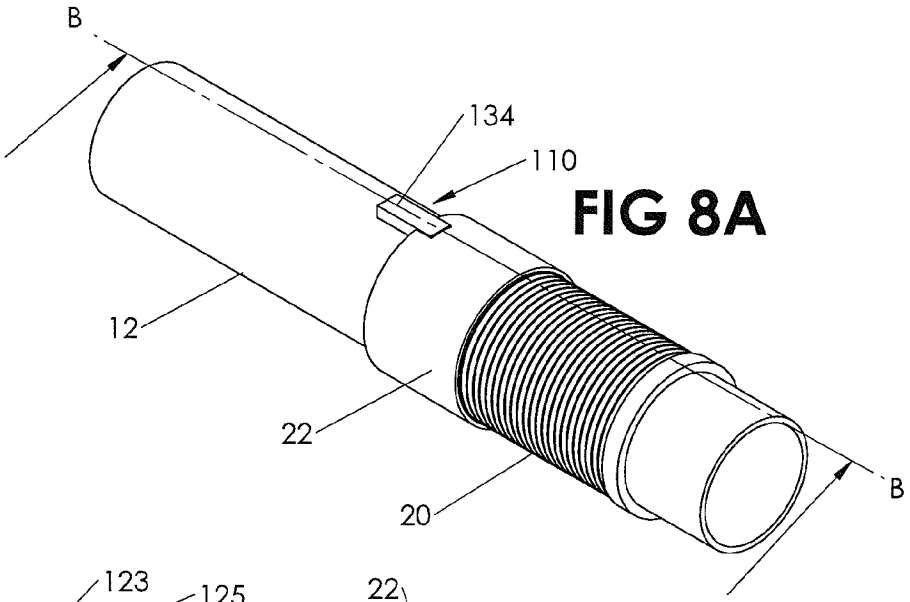
FIG 8A
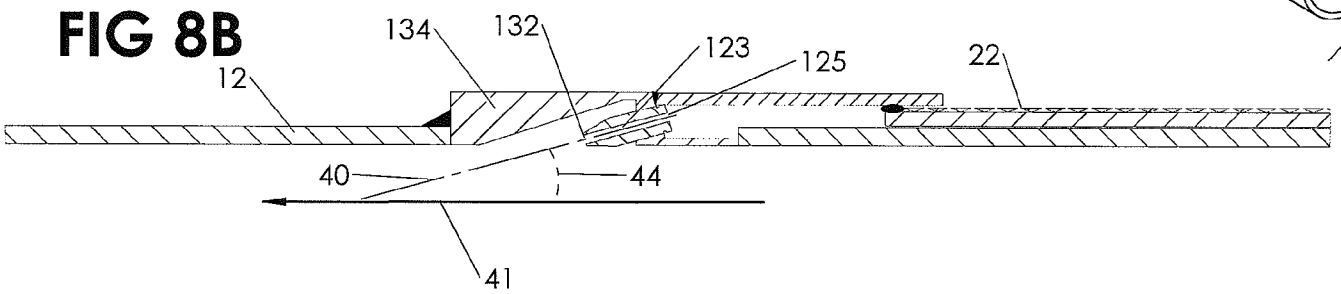
FIG 8B
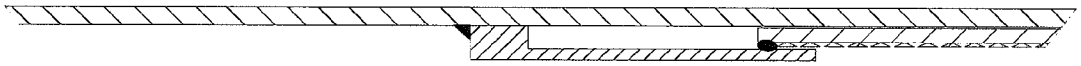

METHOD AND APPARATUS FOR CONTROLLING THE FLOW OF FLUIDS INTO WELLBORE TUBULARS

FIELD

The disclosure relates to systems, methods, and devices for selective control of distributed fluid flow into a wellbore tubular, and for pumping/lifting produced fluids within the wellbore tubular. More particularly, the disclosure relates to the use of divergent passageways (often referred to as a Venturi) to create a desired flow characteristic.

BACKGROUND

Hydrocarbons are recovered from subterranean formations using wells drilled into the formations, typically completed with metal casing along the length of the wellbore with perforations or sand screens across the formation of interest to allow flow of formation fluids into the wellbore. These perforations may be separated from each other with collapsed formation particles, cement, or packers. It is in many cases desirable to have near uniform production from each completed zone along the wellbore because uneven drainage can result in increased production of undesirable fluids. Additionally it is desirable to have production of undesirable fluids selectively reduced by an autonomous device in the wellbore.

It is known to use flow restriction devices of various configurations to meet these same objectives. See for example U.S. Pat. No. 8,312,931 to Xu et al. and CA 2,816,646 to McNamee et al. Flow restriction devices can be used in a 'tubing conveyed', or 'liner conveyed' configurations, with or without isolation packers, with or without sand screens.

Flow restriction devices may be used for both injection and production of fluids. Flow restriction devices used in wellbores in production service use orifices, tubes, complex flow paths using changes in inertial direction, and mechanical devices to create the desired flow characteristics that are dependent on fluid properties.

Divergent nozzles (divergent flowpaths) have been used in many applications, including flow restriction devices distributed along the length of a tubing string for steam injection. For example, see U.S. Pat. No. 4,248,302 to Churchman, U.S. Pat. No. 4,648,455 to Luke, U.S. Pat. No. 5,141,055 to Chien et al., and U.S. Pat. No. 6,708,763 to Howard et al. However, they have not been used in flow restriction devices distributed along the length of a production wellbore tubular.

Prior disclosures describe the use of a nozzle with an opening near the throat followed by a divergent section to pump fluids. Nozzles with a divergent section used in this manner are referred to as eductors, ejectors, and thermocompressors in surface applications, and jet pumps in subsurface applications. In previous wellbore-related disclosures and applications the power fluid is injected into the wellbore at high pressure from surface. No prior disclosure or application uses the production fluid flowing into the wellbore tubular through flow restriction devices distributed along the length of the production wellbore tubular as the power fluid for the inflow control device.

SUMMARY

Disclosed is a method and apparatus for controlling distributed fluid flow into a wellbore tubular to create an optimal pressure drop vs flow rate relationship that is dependent on fluid properties. The flow characteristics of the device can be tailored to various applications to preferentially allow or restrict the production of fluids according to their properties, such as phase, viscosity, density, temperature, bubble point, and gas/vapor content. The device can be designed to operate with subcritical flow, critical/choked flow or supercritical flow conditions.

To create the desired flow characteristic, described herein are flow restriction devices comprising divergent passageways (often referred to as a Venturi). The flow restriction devices are connected to a wellbore tubular so that fluid flows from the formation (e.g., from the production zone), through the device and into the bore of the tubular. As detailed further, below, the devices may be positioned on the outside of the tubular (e.g., around the circumference), on the inside of the tubular (e.g., on an inner surface), or they may be two-part devices with a component on the outside and on the inside (e.g., centrally in the bore of the tubular). In some embodiments, the device is contained in a threaded wellbore tubular coupling that is connected to the wellbore tubular.

More than one flow restriction device may be used on any one wellbore tubular. Thus, a plurality of nozzles may be distributed around the circumference of the wellbore tubular. More than one divergent passageway may be included in any one flow restriction device. If a device has more than one divergent passageway, these passageways may be connected in sequence or parallel, or both.

In one embodiment the divergent passageway includes an opening near the throat of the passageway, to recirculate fluid within the device. In another embodiment the device includes an opening near the throat of the divergent nozzle to entrain fluid from the bore of the wellbore tubular. In this latter embodiment, the flow characteristic of the fluid exiting the device is dependent not only on the properties of the fluid entering, but also on the fluid properties on the downstream side of the device (in the bore of the wellbore tubular).

Also disclosed herein is a flow restriction device (using orifices, tubes, labyrinthine flowpaths, divergent flowpaths, or mechanical devices) in which the discharged flow is aligned within 60 degrees of the direction of flow in the bore of the wellbore tubular.

In one aspect, disclosed herein is an apparatus for controlling flow of a fluid into a wellbore tubular from a production zone comprising:

a) a housing connectable to the wellbore tubing adjacent to the production zone and
b) at least one divergent passageway disposed within said housing between:
   i) a first opening in the housing for entry of the fluid from the production zone into the divergent passageway, and
   ii) a second opening in said housing for exit of the fluid from the divergent passageway and into the bore of the wellbore tubular,
c) the at least one divergent passageway comprising:
   i) a throat disposed at the first opening or between the first opening and the second opening, and
   ii) a divergent section disposed between the throat and the second opening, wherein the angle of divergence or average angle of divergence in the divergent section is between 2° and 40°.

In one embodiment, the apparatus further comprises a convergent section disposed between the first opening and the throat, wherein the angle of convergence or average angle of convergence in the convergent section is between 2° and 60°.

In one embodiment, the apparatus further comprises a connection for connecting the apparatus to a device in the same flowpath that minimizes the influx of particulate matter into the bore of the wellbore tubular.

In one embodiment of the apparatus the housing comprises two parts, a first part connectable to the outside of the wellbore tubular and a second part disposed inside the bore of the wellbore tubular, wherein the first opening is in the first part and the second opening is in the second part.

The divergent section may be symmetric, asymmetric, straight or curved. In one embodiment the divergent section reconnects with the throat enabling fluid to recirculate within the device.

In some embodiments the apparatus comprises two or more divergent passageways between the first opening and the second opening that may be connected to one another in series, in parallel or both.

In some embodiments the apparatus further comprises at least one additional opening in the throat that entrains fluids from the bore of the wellbore tubular, or comprising at least one additional opening in the divergent section that recirculates fluid within the apparatus.

In some embodiments the exit of the fluid from the passageway and into the wellbore tubular is aligned within 60 degrees with the direction of flow in the bore of the wellbore tubular.

In another aspect described herein is a method for controlling distributed flow of fluids into a wellbore tubular from a production zone comprising the steps of:

a) connecting at least two flow restriction devices along the length of the wellbore tubular, said at least two flow restriction devices each comprising:
   i) a first opening for entry of the fluid from the production zone into the flow restriction device,
   ii) a second opening for exit of the fluid from the flow restriction device into the bore of the wellbore tubular,
   iii) at least one divergent passageway disposed between the first opening and the second opening, said divergent passageway having a throat disposed at the first opening or between the first opening and the second opening, and a divergent section disposed between the throat and the second opening, and
   iv) wherein the average angle of divergence in the divergent section is between 2° and 40°, and
b) inserting the wellbore tubular into the wellbore and to the production zone, and
c) enabling fluid flow from the production zone into the first opening, through the divergent passageway and out the second opening into the bore of the wellbore tubular.

In one embodiment of the method, the flow restriction device is connected to an outside surface of the wellbore tubular.

In one embodiment of the method the flow restriction device comprises two parts, a first part and a second part, and the first part is connected to an outside surface of the wellbore tubular, and the second part is connected to the inside of the wellbore tubular.

The flow of production fluid into the wellbore tubular from the production zone through the device is sub-critical, critical (sonic/choked), or super-critical.

In one aspect, disclosed herein is an apparatus for controlling flow of a fluid into a wellbore tubular from a production zone comprising:

a) a housing connectable to the wellbore tubing adjacent to the production zone and
b) at least one passageway disposed within said housing, said passageway comprising:
a) a first opening for entry of the fluid from the production zone into the passageway, and
b) a second opening for exit of the fluid from the passageway and into the bore of the wellbore tubular,
wherein the exit of the fluid from the passageway and into the wellbore tubular is aligned within 60 degrees with the direction of flow in the bore of the wellbore tubular.

In another aspect described herein is a method for controlling flow rate of a fluid into a wellbore tubular from a production zone comprising the steps of:

a) connecting at least two flow restriction devices along the length of the wellbore tubular, said at least two flow restriction devices each comprising:
   i) a first opening for entry of the fluid from the production zone into the flow restriction device, and
   ii) a second opening for exit of the fluid from the flow restriction device into the bore of the wellbore tubular,
wherein the exit of the fluid from the passageway and into the wellbore tubular is aligned within 60 degrees with the direction of flow in the wellbore tubular,
b) inserting the wellbore tubular into the wellbore and to the production zone, and
c) enabling fluid flow from the production zone into the first opening, through the passageway and out the second opening into the bore of the wellbore tubular.

BRIEF DESCRIPTION OF THE DRAWINGS

FIGS. 8A and B are a flow restriction device that does not have a divergent section but that aligns the discharged flow from the device at an angle between 0 and 60 degrees with the direction of flow within the wellbore tubular. FIG. 8B is a cross section taken along line B-B of FIG. 8A.

DETAILED DESCRIPTION

The present disclosure provides a flow restriction device for regulating the flow of production fluids from subterranean formations into the bore of a wellbore tubular. The typical utility of the flow restriction device includes preventing or reducing the negative effects of the following on desired hydrocarbon production and wellbore equipment/tubular damage: steam breakthrough/coning; gas breakthrough/coning; water breakthrough/coning; solids production; and corrosive fluids production.

The flow restriction device comprises at least one divergent passageway, often referred to as a Venturi nozzle, to create the desired flow characteristics. The divergent passageway uses the Bernoulli Effect to recirculate fluid within the device. The flow of the fluid though the flow restriction device results in a pressure drop that is dependent on fluid properties and flow rate that, in combination, control the flow rate of the fluid into the wellbore tubular.

The flow restriction device may further comprise means of entraining fluid from the bore of the wellbore tubular to achieve the desired flow characteristics that are dependent on fluid properties.

The flow restriction device is used in hydrocarbon production, including conventional hydrocarbon production, and also in enhanced recovery utilizing gas floods, water floods, solvent floods, polymer floods, steam floods, SAGD, SAGD with added liquid or gas solvents, SAGD with re-injected produced gasses, SAGD with added exhaust gas, CSS, CSS with added solvents, or other processes using miscible and immiscible agents, or combinations thereof. As used herein, the term "fluid" or "fluids" includes liquids, gasses, hydrocarbons, water, steam, multiphase fluids, emulsions, and slurries.

Figure 1:
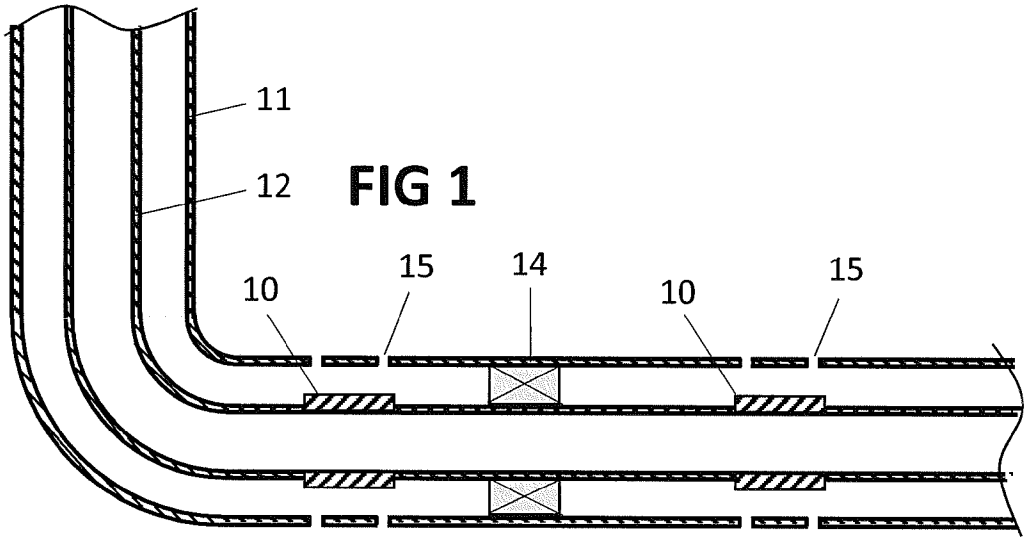
FIG. 1 is a schematic elevation view of an exemplary 'tubing-conveyed' multi-zonal wellbore assembly which incorporates a plurality of flow restriction devices in accordance with the present disclosure.

FIG. 1 shows an exemplary wellbore that has been drilled into a formation from which it is desired to produce hydrocarbons. The wellbore is cased by metal casing 11, as is known in the art, with a number of perforations, slots, or screens 15 to allow production of fluids from the formations into the wellbore. The wellbore has wellbore tubular 12, in this case a production assembly, generally known as a tubing string or scab-liner within the casing. Flow restriction devices 10 described herein are positioned at selected points along the tubular 12. Optionally, packers 14 are placed along the length of the production assembly to prevent uncontrolled flow along the annulus between the flow restriction devices 10. In the exemplary diagram only two flow restriction devices are shown; however, there may in fact be a large number of flow restriction devices 10 arranged along the length of the wellbore tubular 12. The flow restriction devices are used to equalize production along the length of the tubular 12, to minimize the flow of undesired fluids into the wellbore, and/or to protect other wellbore equipment from damage by excessive fluid velocities. Each flow restriction device 10 deployed along the wellbore tubular may be the same, or various configurations of the flow restriction devices with different flow characteristics may be deployed at different zones along the same production assembly. The flow restriction devices are made with materials, coatings, or inserts that have corrosion resistant and/or erosion resistant properties.

Figure 2:
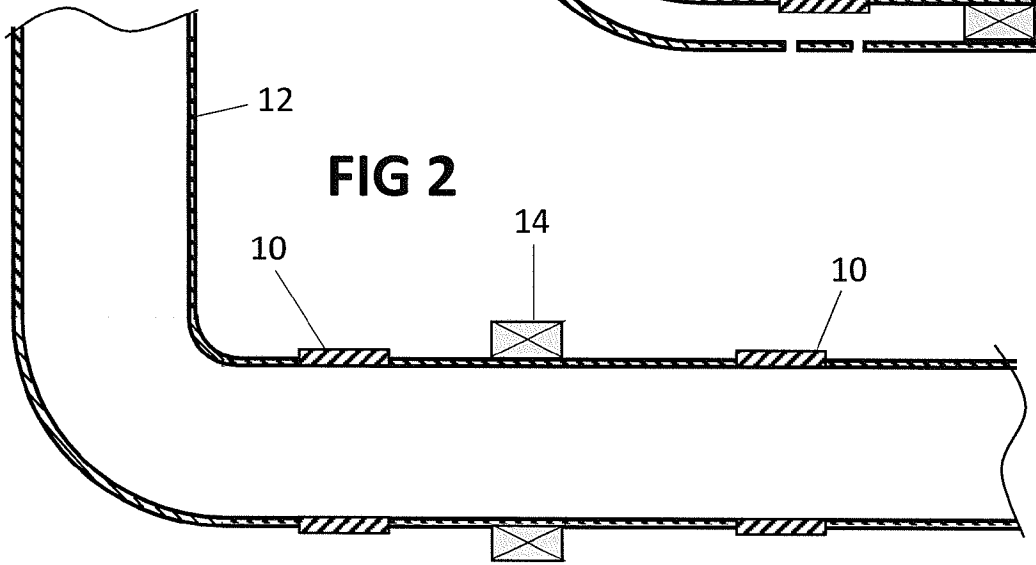
FIG. 2 is a schematic elevation view of an exemplary 'open-hole', or 'liner-conveyed' multi-zonal wellbore assembly which incorporates a plurality of flow restriction devices in accordance with the present disclosure.

FIG. 2 shows an exemplary 'open-hole' multi-zonal wellbore arrangement wherein the flow restriction devices of the present disclosure may be used. Construction and operation of the open hole wellbore is similar in most aspects to the wellbore described previously, except that the wellbore tubular 12 with the flow restriction devices 10 is in direct contact with the formation. A plurality of flow restriction devices 10 are placed along the wellbore tubular 12 to allow production of fluids from the formations into the wellbore tubular. Packers or cement 14 may be used to prevent uncontrolled flow between flow restriction devices in the annulus between the wellbore tubular and the formation. It may be desirable to include means to control influx of particulate matter in the open-hole configuration.

As shown in the Figures herein, flow restriction device 10 comprises a housing 34, within which is disposed a divergent passageway 23 for conducting fluid through the flow restriction device 10. The housing 34 has an opening for fluid entry 25 and an opening for fluid exit 32, a throat 26 and a divergent section 28. The passageway is aligned so that the direction of flow proceeds in through opening 25, through the throat 26, through the divergent section 28 and out through opening 32. In some embodiments the divergent passageway 23 further comprises a convergent section 30 upstream of the throat 26.

The throat 26 of the divergent passageway 23 is the part of the passageway that has the smallest diameter, or cross-sectional area. Thus, the diameter or cross-sectional area of the divergent section and the convergent section, if present, are greater than the diameter or cross-sectional area of the throat 26. If the passageway has a gradual reduction in cross-sectional area upstream of the throat, it is referred to as a convergent section, and if the passageway has a gradual increase in cross-sectional area downstream of the throat it is referred to as a divergent section. The purpose of this gradual change in cross sectional area is to reduce turbulence in the flow. In embodiments of the device 10 in which the divergent passageway does not comprise a convergent section, there is an approximately square edge at the upstream end of the throat which may be the opening for fluid entry 25.

FIGS. 3A to 3D show an embodiment of a flow restriction device 10, in which the flow restriction device is assembled on the wellbore tubular 12 in combination with a device for minimizing influx of particulate matter entrained in the produced fluids, generally referred to as a "sand screen" 20. A wire-wrap screen is shown, however, other screens such as a slotted liner, woven mesh, matted mesh screen, or perforated shroud may be used. In this embodiment, the flow of produced fluids is through the sand screen 20, under a sleeve 22 where the flow from all sides of the sand screen merge, through a divergent passageway, and into the wellbore tubular. In the configuration shown the housing 34 of the flow restriction device 10 is inserted into a slot 24 in the wellbore tubular 12, however other embodiments may use a housing that extends around the full circumference of the wellbore tubular 12 and that is not embedded therein.

In this embodiment the divergent passageway 23 is formed by an insert 35 that is press-fit, threaded, or connected with a snap ring 21 to the housing. The insert may be made from sintered tungsten carbide or similar material. The housing 34 may be made from stainless steel, or carbon steel and may be coated on the inside surfaces with a material with good erosion and corrosion resistance. The device 10 may be affixed to the wellbore tubular and to the sand screen by welding, and all components of the housing 34 may be welded.

Figures 3A, 3B, 3C:
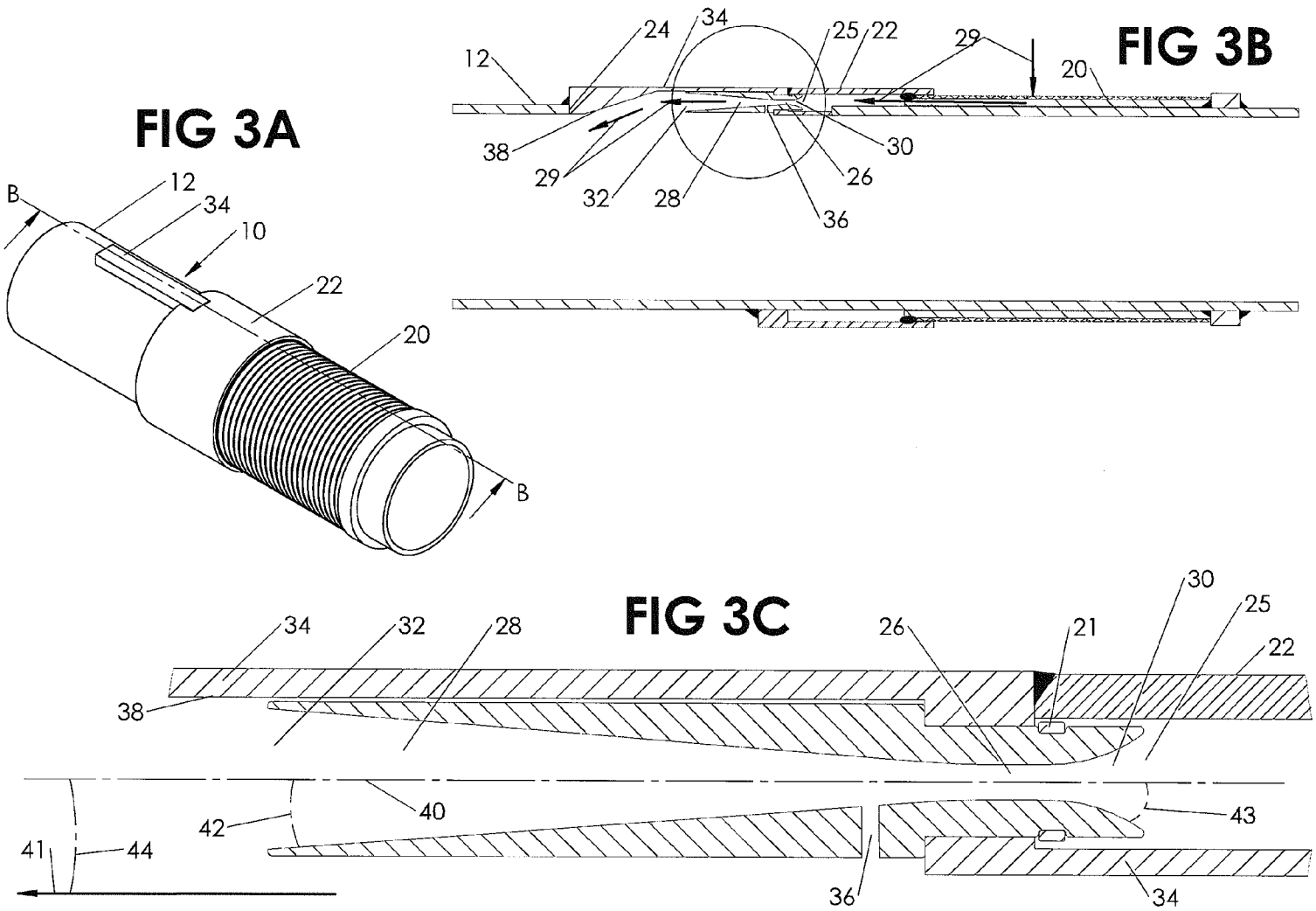
FIG. 3A is an isometric view of an embodiment of the flow restriction device of the present disclosure.
FIG. 3B is a cross section taken along line B-B of FIG. 3A.
FIG. 3C is an enlarged view of a part of FIG. 3B.

In this embodiment the flow restriction device 10, and in particular the divergent section 28 is configured such that the discharged flow through the device is aligned with the direction of flow within the wellbore tubular at an angle 44 of 0 degrees. The flow of fluid from the outside of the wellbore through the flow restriction device is shown with arrows 29, and the flow of fluid on the inside of the wellbore is shown by arrows 41. The purpose of aligning the discharge with the direction of flow in the bore of the wellbore tubular is to add energy (i.e., lift or pump) to the flow in the bore of the wellbore tubular, to minimize erosion and corrosion of the wellbore tubular, or to simply to be able to fit the largest most efficient nozzle possible within the device 10. In this preferred embodiment, the divergent passageway also includes a convergent section 30 upstream of the throat 26 to increase efficiency. The centerline 40 of the divergent passageway is shown in FIG. 3C and the angles of convergence 43 and divergence 42 can be measured relative to this centerline. The average angle of divergence in the divergent section of the flow restriction device described herein is between 2° and 40°, in order to efficiently recover pressure from the high velocity flow created in the throat.

In the embodiment shown in FIG. 3C, the angle of convergence 43 is approximately 30 degrees and the angle of divergence 42 is approximately 5 degrees.

Figure 3D:
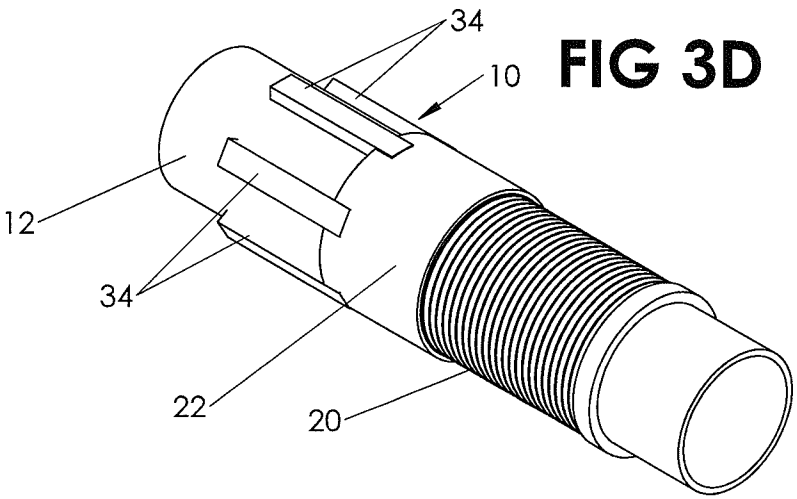
FIG. 3D shows a plurality of flow restriction devices assembled around the circumference of the wellbore tubular to efficiently transfer energy from the inflowing fluid to lift or pump fluids from deeper in the wellbore tubular.

As shown in this embodiment, the divergent passageway 23 may include an opening 36 at or a short distance downstream of the throat 26 that entrains fluid from the bore of the wellbore tubular 12. The opening 36 alters the flow characteristics (pressure drop vs flow rate) of the device to depend the fluid properties of the fluid in the bore of the wellbore tubular 12 and/or to increase the efficiency of energy transfer to the flow within the wellbore tubular. To further increase the efficiency of energy transfer to the flow within the wellbore tubular, more than one device 10 may be used, and these devices may be distributed around the circumference of the wellbore tubular as shown in FIG. 3D. Additionally, the orientation of the discharged flow need not necessarily be aligned with the axis of the wellbore tubular; a twist relative to the axis of the wellbore tubular could be used to create a spinning flow in the bore of the wellbore tubular to further increase the efficiency of energy transfer or influence the flow regime within the wellbore tubular.

The housings 34 and surfaces 38 which the flow through the housings impact may be built from, or coated with, corrosion and/or erosion resistant materials such as tungsten carbide.

Divergent flowpaths commonly referred to as a Venturi nozzles, eductors, ejectors, or thermocompressors have useful applications to a flow restriction device because the fluid flowing through the throat increases in velocity and drops in pressure according to the Bernoulli principle. The gradually increasing cross-section of the flowpath after the throat in the divergent (expansion) section allows the velocity of the fluid to be converted back to pressure (pressure recovery), which is not possible with orifices, tube-like, or laybrinthine flowpaths. Pressure recovery in a divergent flowpath is 80% to 90%, relative to the minimum pressure at the throat of the flowpath when an angle of divergence of less than 15 degrees is used. Additionally this gradual increase in cross section following the throat enables sonic choking of compressible flows, and choking of liquid flows when the pressure at the throat decreases to the bubble point of the fluid. This is useful in a SAGD production well application because it enables choking of steam, non-condensable gasses, and higher temperature liquids with relatively little total pressure drop across the flow restriction device, while allowing relatively more flow of cooler fluids which are more desirable to produce. These properties of divergent flowpaths have been exploited previously in process control valves, downhole fixed and adjustable chokes, steam injection flow restriction devices, and gas lift valves.

The use of divergent flowpaths in a flow restriction device is well-suited to applications such as:

1. SAGD production wells where it is desirable to preferentially produce colder heavier liquids while minimizing the influx of steam, gas, and liquids with minimal subcool (temperature close to the bubble point or saturation temperature); and
2. Conventional oil production wells where it is desirable to preferentially produce more viscous oil while minimizing the influx of relatively lower viscosity gas and water.

The ability to entrain fluid from the bore of the wellbore tubular within the flow restriction device 10 is another aspect of device described herein. A difference in the properties of the fluid flowing through the divergent passageway 23 and the fluid being entrained by the device can be used to achieve the desired device flow characteristic. For example, if a liquid is flowing through the device 10 and there is liquid in the bore of the wellbore tubular, the pressure recovery in the fluid after passing through the throat 26 will be relatively high, enabling a high volume of liquid to flow through the device. However, if a gas is flowing through the device and there is liquid in the bore of the wellbore tubular, the liquid that is entrained will significantly reduce the pressure recovery after the throat thereby further reducing the amount of gas that is able to flow through the device.

Figure 4A:
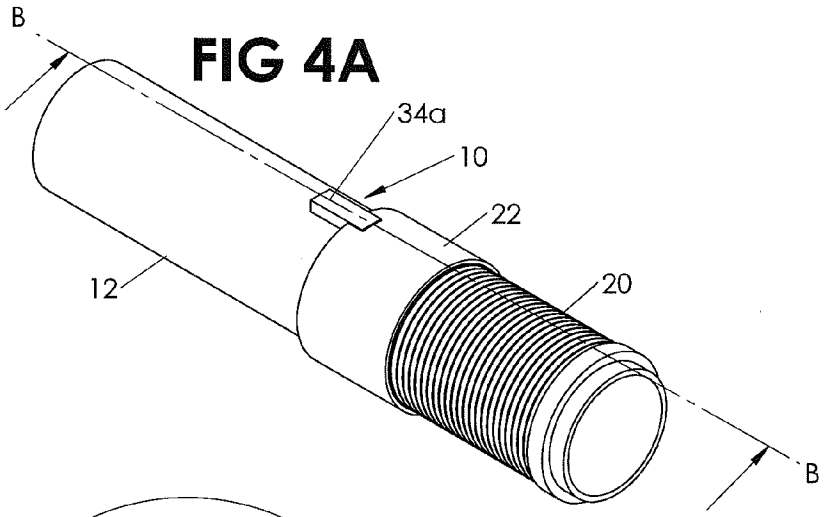
FIG. 4A, is an isometric view of an embodiment of the flow restriction device of the present disclosure where a part of the flow restriction device is assembled within the wellbore tubular, and is configured to align the discharged flow from the device at an angle between 0 and 60 degrees with the direction of flow within the wellbore tubular.
Figure 4B:
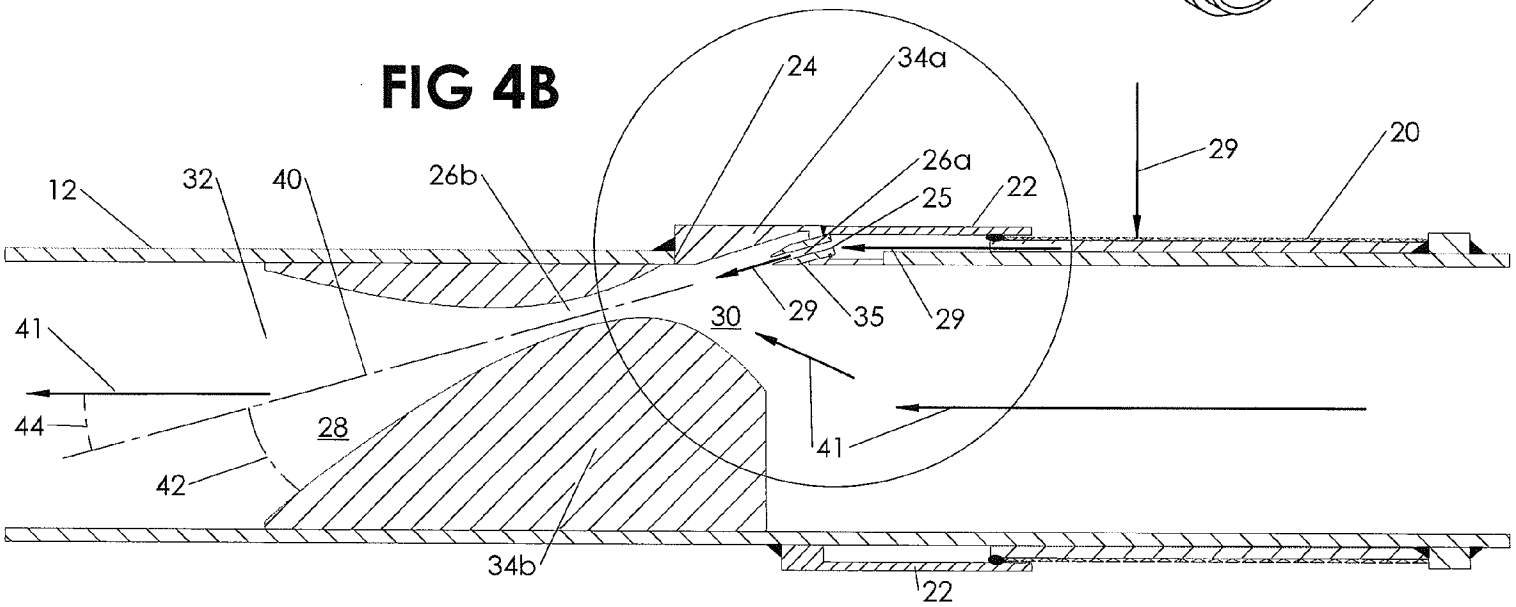
FIG. 4B is a cross section taken along line B-B of FIG. 4A.

FIGS. 4A and B show another embodiment of the flow restriction device 10, in which the divergent passageway 23 is disposed, at least in part, within the wellbore tubular 12, to increase the efficiency of energy transfer to the flow within the wellbore tubular. In this embodiment the flow restriction device 10 comprises a two-part housing 34, an external part 34*a* that is disposed on the outside of the wellbore tubular 12 and an internal part 34*b* that is disposed on the inside of the wellbore tubular. The opening for production fluid entry 25 is disposed in housing 34*a*. The device then further entrains fluid from the wellbore in a convergent section 30 in housing 34*b*. The flow of fluid from the outside of the wellbore through the flow restriction device is shown with arrows 29. The entrained wellbore fluid flow is accelerated in the convergent section 30 as it is mixed with the high velocity flow discharged from a first throat 26*a*, through the convergent section 30 and into a second throat 26*b*. The flow of fluid from the outside of the wellbore through the flow restriction device is shown with arrows 29, and the flow of fluid on the inside of the wellbore is shown by arrows 41. Pressure is recovered in the divergent section 28 which enables pumping of the fluids within the wellbore.

In this embodiment the first throat 26*a* is formed by an insert 35 that is press-fit, threaded, or connected with a snap ring to the housing. The insert may be made from sintered tungsten carbide or similar material. In other embodiments the first throat could be as simple as a hole drilled directly through the housing or the wellbore tubular at an angle that is aligned with the direction of flow within the wellbore tubular.

In other embodiments (not shown) the first throat 26*a* may also be disposed in internal housing 34*b*.

In these embodiments the discharged flow through the device is aligned with the direction of flow 41 within the wellbore tubular at an angle 44 of approximately 10 degrees to efficiently add energy to (i.e., lift or pump) the flow in the bore of the wellbore tubular. The divergent section has a curved profile with an average angle of divergence 42 of approximately 20 degrees.

In the preferred embodiment shown, no parts of the external housing 34*a* protrude into the inside diameter of the wellbore tubular, which is beneficial if a workover operation was performed where the internal housing 34*b* needed to be removed to regain mechanical access to a location in the wellbore that is below the device. The internal housing 34*b* can be removed while leaving the external housing 34*a* in place. This can be accomplished for example by milling or drilling out the internal housing, or by mechanical retrieval with fishing tools. In the preferred embodiment shown, only a single divergent passageway is disposed in the internal housing 34*b*, however more than one divergent passageway may be disposed in the internal housing 34*b*.

Figure 5A:
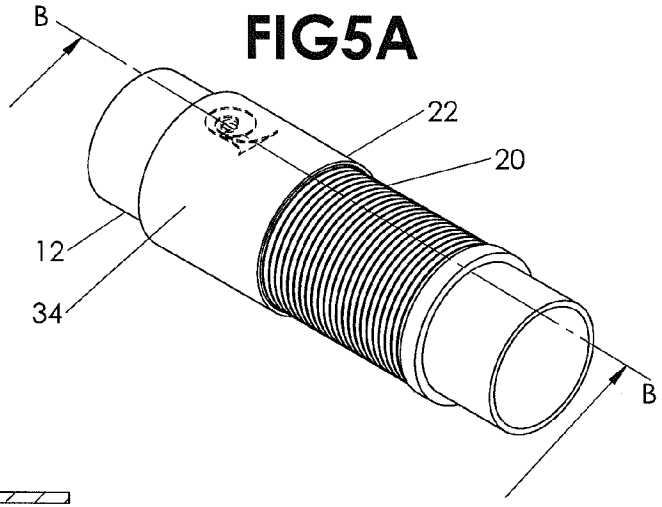
FIG. 5A is an isometric view of an embodiment of the flow restriction device of the present disclosure that uses a divergent passageway with a curved section to recirculate a portion of the flow within the device.
Figure 5B:
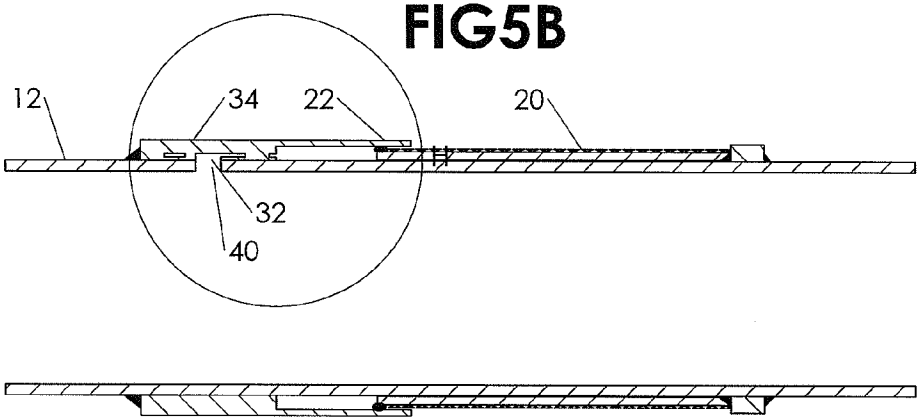
FIG. 5B is a cross section taken along line B-B of FIG. 5A.
Figure 5C:
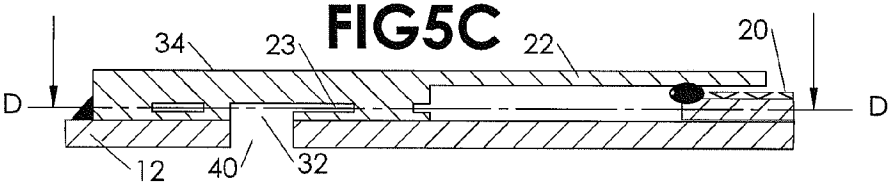
FIG. 5C is an enlarged view of a part of FIG. 5B.

FIGS. 5A to E, show embodiments of the flow restriction device 10 that incorporate a divergent passageway 23 that is created within housing 34 disposed on the outside surface of the wellbore tubular 12. In the embodiment shown, the housing 34 is on the outside of the wellbore tubular; however the divergent passageway 23 could also be disposed inside the wellbore tubular in housings that are mounted on an inside surface of the wellbore tubular, or within a threaded wellbore tubular coupling. In this embodiment, as shown in FIG. 5C, housing 34 and sleeve 22 form a unitary construct, however they may also be constructed of multiple pieces of steel, stainless steel, or sintered tungsten carbide that are press-fit, welded, threaded, or by some other method fixed together.

An opening 32 in the housing 34 is in fluid communication with an opening 40 in the wall of the wellbore tubular 12, thereby providing a flowpath from the outside to the inside of the wellbore tubular. In the embodiment shown in FIG. 5D, divergent passageway 23 comprises a convergent section 30 and a throat 26 that are followed by a curved divergent section 28. A curved passageway is used to separate, within the passageway, different fluids according to the fluid properties, and recirculate preferentially either the more or less dense fluid. Fluid passes from divergent section 28 through opening 32 to the inside of the wellbore tubular. The divergent section 28 may also reconnect to the throat 26 of the passageway, as shown at 37, to recirculate a portion of the flow within the device.

Figure 5D:
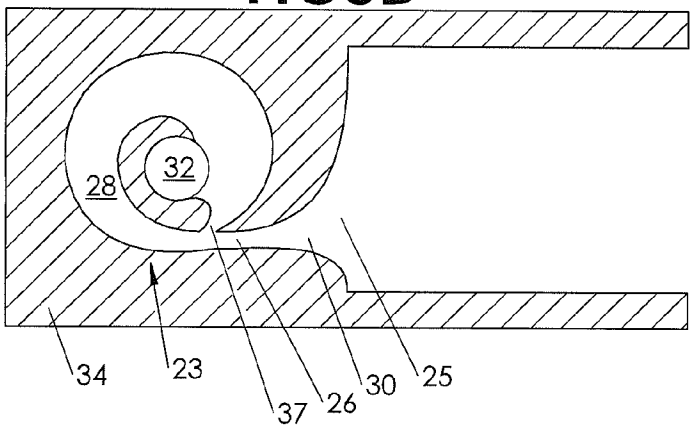
FIG. 5D is a cross section taken along line D-D of FIG. 5C. In the exemplary configuration shown, the higher density fluid will recirculate preferentially through the device to create the desired flow characteristics, however other geometries could vary the type of fluid that recirculates, or could be used to create unstable flow conditions.

In the configuration shown in FIG. 5D, the higher density fluid will tend to recirculate within the device while lower density fluids pass through the opening 32 into the wellbore tubular. A similar geometry (not shown), but in which the opening 32 is moved to the outside of the curved passageway, could be used to instead recirculate the lower density fluid phase, or alternate opening placements could be used to create unstable flow conditions depending on the properties of the fluids flowing through the device.

Figure 5E:
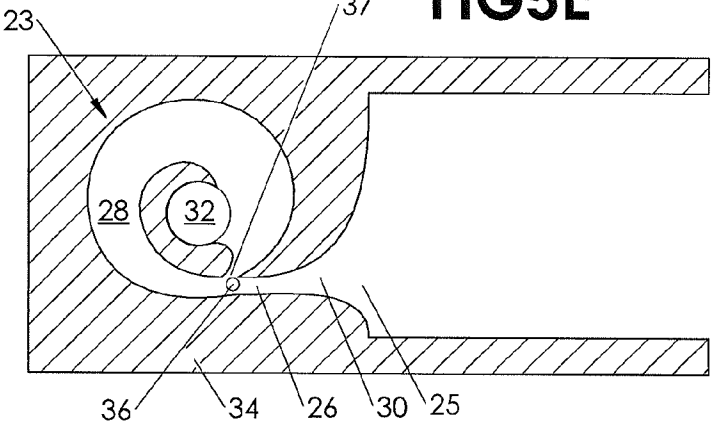
FIG. 5E is a cross section view of an embodiment of a divergent passageway within the flow restriction device taken along a line similar to that used to generate FIG. 5D. An additional opening in this passageway, as compared to that of FIG. 5D, allows the device to entrain fluid from the bore of the wellbore tubular.

FIG. 5E shows another embodiment of a divergent passageway 23 that may be used in the flow restriction device 10, in most aspects similar to that discussed previously in FIG. 5D. In this embodiment an additional opening 36 at or a short distance downstream of the throat, through the housing and through the wellbore tubular allows the device to entrain fluid from the bore of the wellbore tubular as well as to recirculate a portion of the combined flow within the device. The purpose of entraining fluid from the bore of the wellbore tubular is to achieve the desired flow characteristics (pressure drop vs flow rate) of the device by making them dependent on the fluid properties of the fluid within the wellbore tubular. Additional openings could be added to the passageway at various locations within the device to further optimize the device's flow characteristics.

Figure 6A:
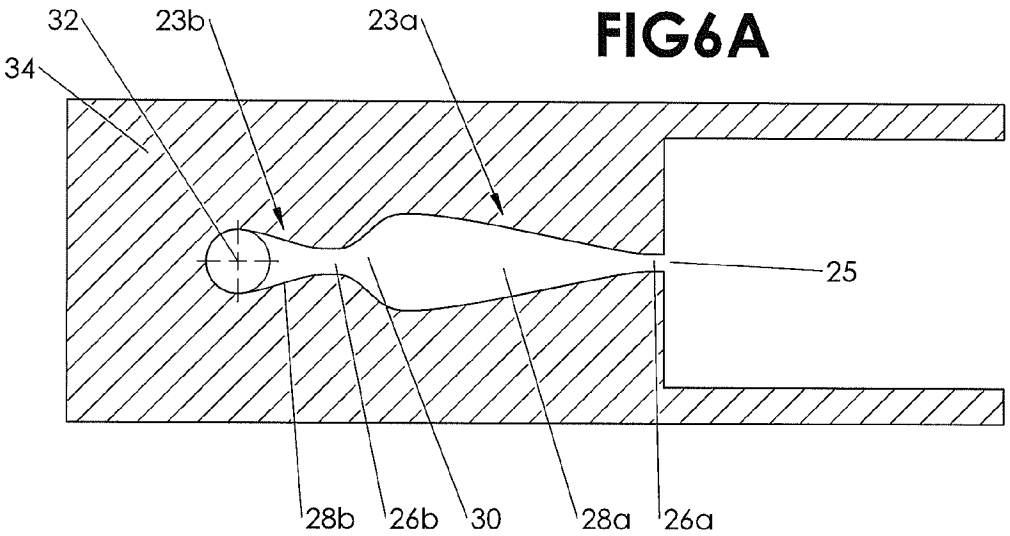
FIG. 6A is a schematic cross section view of an embodiment of a divergent passageway within the flow restriction device of the present disclosure, similar to the view of FIG. 5C and FIG. 5D. Multiple divergent passageways/flowpaths are placed in series to create the desired flow characteristics.

FIG. 6A (in a view similar to that of FIGS. 5D and 5E) shows an embodiment of the flow restriction device described herein that comprises two divergent passageways 23*a* and 23*b*, in series, to achieve the desired flow characteristic. Additional passageways could be added. Each passageway comprises a throat (26*a, b*) and a divergent section (28*a, b*). One of the divergent passageways has a convergent section (23*b*), and one does not (23*a*). The sizes and geometries of the passageways and their various sections need not be the same. As illustrated in FIG. 6A, the throat 26*a* in the diameter of first passageway 23*a* is smaller than that of throat 26*b* in the second passageway 23*b*. An opening 32 connects the divergent section 28*b* to the inside of the wellbore tubular.

Figure 6B:
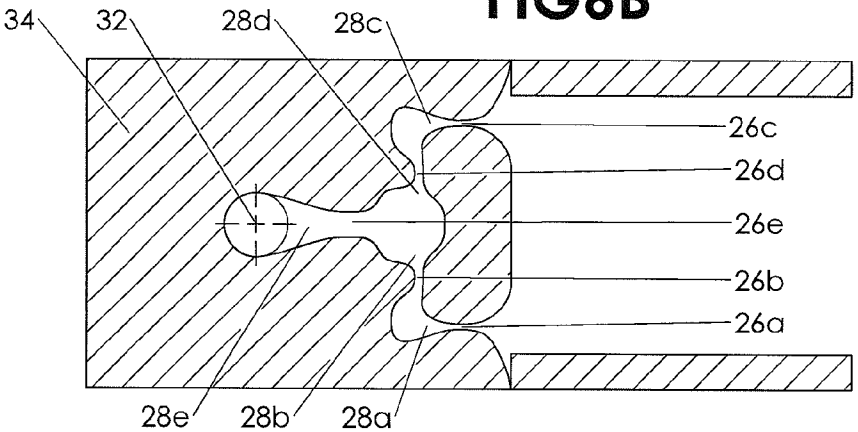
FIG. 6B is a schematic cross section view of an embodiment of a divergent passageway within the flow restriction device of the present disclosure, similar to the view of FIG. 5C. Multiple divergent passageways/flowpaths are placed in series and in parallel where the flow through the multiple passageways impact within the device.

FIG. 6B (in a view similar to that of FIGS. 5D and 5E) shows an embodiment of a flow restriction device which includes multiple divergent passageways, to achieve the desired flow characteristic. The device is designed so that the flow through multiple throats (26 *a* to *e*), multiple convergent sections and multiple divergent sections (28 *a* to *e*) impact within the device. This configuration with impacting flows from the various passageways could create unstable flow within the device under certain conditions which could be used to create the desired pressure-drop dependency on the properties of the fluid flowing through the device. The sizes and geometries of the passageways or their various sections need not be the same. An opening 32 connects the divergent section 28*e* to the inside of the wellbore tubular.

Each flow restriction device may have a single passageway as described above, or a plurality of similar or dissimilar passageways.

Figure 7:
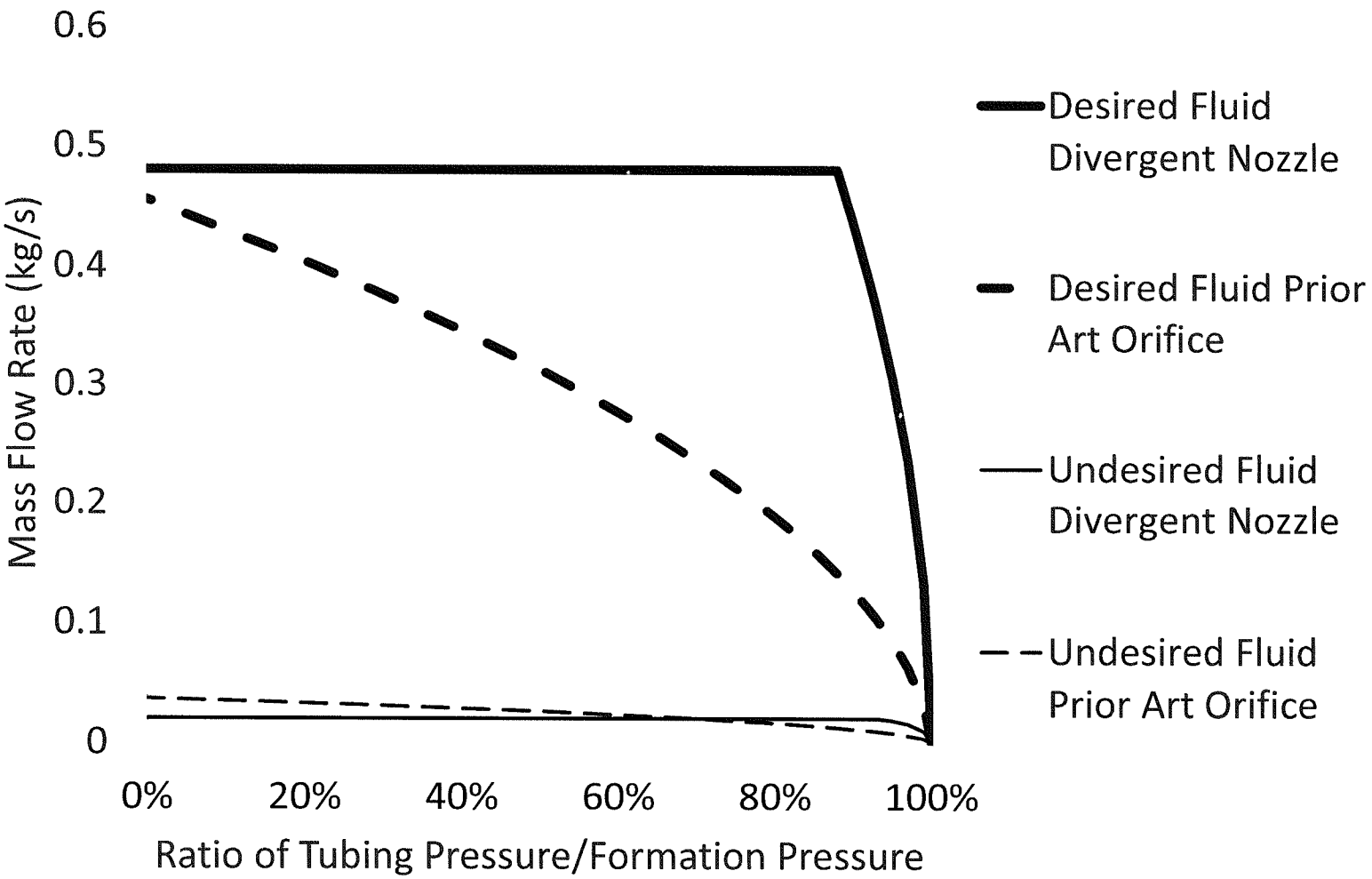
FIG. 7 is a graph of fluid flow characteristics that shows the advantages of the flow restriction device of the current disclosure as compared with an orifice for application to a SAGD production well.

FIG. 7 is a graph that demonstrates the advantages of the flow restriction device 10 of the current disclosure as compared with a prior art orifice for application to a SAGD production wellbore. In the exemplary case shown, the configuration used is that shown in FIG. 3 using a throat diameter of 4 mm (without the opening to entrain fluid from the bore of the wellbore tubular). Operational parameters have been selected to reflect a typical mid to late life SAGD project with a reservoir operating pressure of 1,000 kPa. In a SAGD production well it is desired to preferentially produce cooler bitumen rather than steam. In order to quantify performance of the various flow restriction devices a new term, 'selection performance', is defined as the ratio of the Desired Fluid mass flow rate (in this case the Desired Fluid is a mixture of bitumen and water at a temperature of 100° C. with a viscosity of 30 cP) and the Undesired Fluid mass flow rate (in this case the Undesired Fluid is steam at the saturation temperature of 180° C. with a viscosity of 0.015 cP). Calculations have been performed for both devices using the same fluid properties. In a typical configuration where the flow restriction device is operating with tubing pressure/formation pressure in the range of 0.7-0.95 it can be seen that the 'selection performance' of the divergent nozzle is 16-24 while the 'selection performance' of the prior art orifice is only 10-11.5. This represents an improvement in 'selection performance' of 60%-110% over the prior art orifice.

In some embodiments and applications, the plurality of divergent passageways and their interconnections can result in phase change of fluids within the device.

FIGS. 8A and B show a flow restriction device 110 that is configured to align the discharged flow from the device at an angle 44 of between 0 and 60 degrees with the direction of flow within the wellbore tubular 41. This device does not have a divergent section and will therefore have a similar flow characteristic to the prior art orifice-type flow restriction devices, however the device is an improvement over prior art devices because it reduces turbulent flow on the surfaces of the wellbore tubular, which can result in erosion or accelerated corrosion of the wellbore tubular This device also adds some pumping effect to fluids within the wellbore tubular. In other embodiments of this device a convergent section or curved sections could be added to the passageway.

Many aspects of the assembly of device 110 onto the wellbore tubular are similar to flow restriction device 10. In the embodiment shown in FIGS. 8A and B, device 110 has a housing 134 within which is disposed a passageway 123 for conducting fluid through the flow restriction device. The housing 134 has an opening for fluid entry 125 into the passageway 123 and an opening for fluid exit 132 out of the passageway. The passageway 123 is aligned so that the direction of flow proceeds through opening 125, through the passageway 123 and out through opening 132. In the device shown in FIG. 8B, passageway 123 is formed by an insert 135 that is press-fit, threaded, or connected with a snap ring to the housing. The insert may be made from sintered tungsten carbide or similar material. In other embodiments of device 110 the passageway 123 could be as simple as a hole drilled directly through the housing or the wellbore tubular at an angle that is aligned with the direction of flow within the wellbore tubular. In the latter embodiment of device therefore, the openings for fluid entry 125 into the passageway 123, and fluid exit 132 out of the passageway are formed by the wall of the wellbore tubular and not by the housing. Housing 134 functions only to collect fluid that passes through sand screen 20.

Device 110 is assembled on the wellbore tubular in a manner analogous to that described for device 10. As described above for device 10, device 110 is assembled on the wellbore tubular 12 in combination with a device for minimizing influx of particulate matter entrained in the produced fluids, generally referred to as a sand screen 20. The flow of produced fluids is through the sand screen 20, under a sleeve 22 where the flow from all sides of the sand screen merge, through the passageway 123, and into the wellbore tubular. In the configuration shown, the housing 134 of the flow restriction device 110 is inserted into a slot 124 in the wellbore tubular 12, however other embodiments may use a housing that extends around the full circumference of the wellbore tubular 12 and that is not embedded therein, analogous to that described above for device 10. As described above for device 10, more than one device 110 may be used on any particular wellbore tubular. And, each flow restriction device 110 may have a single passageway as described above, or a plurality of passageways.

While the flow restriction device has been described in conjunction with the disclosed embodiments and examples which are set forth in detail, it should be understood that this is by illustration only and the flow restriction device is not intended to be limited to these embodiments and examples. On the contrary, this disclosure is intended to cover alternatives, modifications, and equivalents which will become apparent to those skilled in the art in view of this disclosure.

I claim:

1. An apparatus for controlling flow of a fluid into a wellbore tubular from a production zone comprising:

a) a housing connectable to the wellbore tubular adjacent to the production zone and b) divergent passageway disposed within the housing between:

i) a first opening in the housing for entry of the fluid from the production zone into the divergent passageway, and ii) a second opening in the housing for exit of the fluid from the divergent passageway and into a bore of the wellbore tubular, c) the divergent passageway comprising:

i) a throat disposed at the first opening or between the first opening and the second opening, the throat opening having a smaller cross-sectional area than the cross-sectional area of the second opening, and ii) a divergent section disposed between the throat and the second opening, the divergent section having a gradual increase in cross-sectional area from the throat and the second opening, and having an average angle of divergence between 2° and 40°.

2. The apparatus of claim 1 further comprising a convergent section disposed between the first opening and the throat, wherein the average angle of convergence in the convergent section is between 2° and 60°.

3. The apparatus of claim 1 further comprising a connection for connecting the apparatus to a device that minimizes influx of particulate matter into the bore of the wellbore tubular.

4. The apparatus of claim 1, wherein the housing comprises two parts:

a) a first part connectable to an outside of the wellbore tubular and b) a second part disposed inside the bore of the wellbore tubular, and wherein the first opening is in the first part and the second opening is in the second part.

5. The apparatus of claim 1, wherein the divergent section is symmetric, asymmetric, straight or curved.

6. The apparatus of claim 1, wherein the divergent section reconnects with the throat enabling fluid to recirculate within the apparatus.

7. The apparatus of claim 1, comprising second divergent passageway between the first opening and the second opening.

8. The apparatus of claim 7 wherein the two or more divergent passageways are connected to one another in series.

9. The apparatus of claim 7 wherein the two or more divergent passageways are connected to one another in parallel.

10. The apparatus of claim 7 wherein the two or more divergent passageways are connected to one another in series and in parallel.

11. The apparatus of claim 1 further comprising an additional opening in the throat that entrains fluids from the bore of the wellbore tubular.

12. The apparatus of claim 1 further comprising an additional opening in the divergent section that recirculates fluid within the apparatus.

13. The apparatus of claim 1 wherein the exit of the fluid from the passageway and into the wellbore tubular is aligned within 60 degrees with a direction of flow in the bore of the wellbore tubular.

14. The apparatus of claim 1, wherein the divergent passageway is made from an insert made from sintered tungsten carbide or similar material that is press-fit, threaded, or connected with a snap ring to the housing.

15. The apparatus of claim 1, wherein the housing is made from stainless steel, or wherein the housing is coated on the inside surfaces with a material with good erosion and corrosion resistance.

16. A method for controlling distributed flow of fluids into a wellbore tubular from a production zone comprising steps of:

a) providing a flow restriction device along a length of the wellbore tubular, comprising:
   i) a first opening for entry of fluid from the production zone into the flow restriction device,
   ii) a second opening for exit of the fluid from the flow restriction device into a bore of the wellbore tubular,
   iii) a divergent passageway disposed between the first opening and the second opening, the divergent passageway having a throat disposed at the first opening or between the first opening and the second opening, and a divergent section disposed between the throat and the second opening,
   iv) wherein the cross-sectional area of the throat opening is smaller than the cross-sectional area of the second opening, and
   v) wherein there is a gradual increase in cross sectional area of the divergent section from the throat to the second opening, and the divergent section has an average angle of divergence between 2° and 40°,
b) inserting the wellbore tubular into the wellbore and to the production zone, and
c) enabling fluid flow from the production zone into the first opening, through the divergent passageway and out the second opening into the bore of the wellbore tubular.

17. The method of claim 16 wherein the connecting of the flow restriction device on the wellbore tubular is connecting the flow restriction device to an outside surface of the wellbore tubular.

18. The method of claim 16 wherein the flow restriction device comprises two parts, a first part and a second part, and the connecting of the flow restriction device on the wellbore tubular is connecting the first part to an outside surface of the wellbore tubular, and connecting the second part to an inside of the wellbore tubular.

19. The method of claim 16 wherein the flow of the production fluid into the wellbore tubular from the production zone through the flow restriction device is sub-critical, critical (sonic and/or choked), or super-critical.

* * * * *